United States Patent [19]
Anezaki
[11] 4,185,223
[45] Jan. 22, 1980

[54] ELECTRON GUN STRUCTURE

[75] Inventor: Yoshimitsu Anezaki, Fukaya, Japan
[73] Assignee: Tokyo Shibaura Electric Co., Ltd., Kanagawa, Japan

[21] Appl. No.: 835,062
[22] Filed: Sep. 21, 1977
[30] Foreign Application Priority Data
Sep. 27, 1976 [JP] Japan ..... 51-114645
[51] Int. Cl.[2] ..... H01J 29/02
[52] U.S. Cl. ..... 313/446; 313/447
[58] Field of Search ..... 313/446, 447, 448, 451, 313/346 R, 409

[56] References Cited
U.S. PATENT DOCUMENTS
4,071,803 1/1978 Takanashi et al. ..... 313/446 X

*Primary Examiner*—Robert Segal
*Assistant Examiner*—Darwin R. Hostetter
*Attorney, Agent, or Firm*—Oblon, Fisher, Spivak, McClelland & Maier

[57] ABSTRACT
An electron gun structure which includes at least one cathode electrode, a plurality of grid electrodes including a first grid electrode, and a heater coil. The cathode electrode consists of a tubular cathode sleeve and an electron emissive coating formed on the closed end of it. The heater coil is positioned within the cathode sleeve and has legs welded to heater supporting straps. The surfaces of the heater straps adjacent the cathode sleeve are constructed such that the arcing start potential between the cathode electrode and the heater supporting straps is lower than the arcing start potential between the cathode electrode and the heater coil, thereby preventing arcing to the heater itself. Furthermore, the arcing start potential between the exposed metal part of the cathode electrode and the first grid electrode is made lower than the arcing start potential between the electron emissive coating on the cathode sleeve and the first grid electrode, so that undesired arcing to the electron emissive coating is also prevented.

1 Claim, 3 Drawing Figures

ELECTRON GUN STRUCTURE

BACKGROUND OF THE INVENTION

1. Field of the Invention

This invention relates to an electron gun structure and particularly to the improvement of an electron gun used for a color cathode ray tube.

2. Description of the Prior Art

Generally, in an electron gun for a cathode ray tube an electron current emitted from a cathode is controlled by a plurality of grid electrodes and radiated as a sharp electron beam of high energy.

In one type of electron gun used for a color picture tube, the various electrodes are mounted on a plurality of glass support rods. These electrodes include three cathode electrodes and five grid electrodes. Each cathode electrode comprises a tubular cathode sleeve with an oxide of electron emissive material being applied as a coating on the forward end surface of the sleeve. Each cathode is indirectly heated by a heater coil which is positioned within the tubular sleeve and which has legs welded to heater supporting straps and mounted by studs on the rods.

In a color picture tube, a high voltage of 20kV to 30kV is applied between this electron gun and the anode of the tube, and this anode voltage may be charged on the inside wall of the neck bulb of the tube and directly discharged from the anode to the grid electrodes or the cathode electrode.

As a result, a high voltage is induced between the first grid electrode and the cathode electrode. This voltage can produce arcing between the cathode and the first grid electrode. Moreover, arcing may also occur between the open edge of the cathode sleeve of the cathode electrode and the facing part of the heater coil.

When arcing occurs between the cathode sleeve and the heater coil, the insulating layer (generally alumina sintered material) on the surface of the heater coil deteriorates so that either the heater and the cathode sleeve of the cathode electrode are short-circuited or a discharge current flows in the heater so that the heater fuses.

Therefore, conventionally, an insulator such as a ceramic disc or a spacer coil has been interposed between the heater and the cathode sleeve. But when an insulator is inserted between the heater and the cathode sleeve, the heat conduction from the heater to the cathode sleeve becomes poor. Also, raising the electron emissive surface to the required temperature takes an excessively long time. Therefore this kind of spacer cannot be used in an electron gun of the so called quick emission start type. Recently, moreover, there has been a strong tendency to lower the power consumed by the heater, in order to save energy.

In order to lower the heater power, it is necessary to make the core wire of the heater thin and long. But the extent to which it can be lengthened is limited because of the capacity of the cathode sleeve and accordingly the core wire must necessarily be made thinner. However, when the core wire is made thinner, breakage of the wire takes place more readily when arcing to the heater has occured.

Also, in recent years, the first grid electrode has commonly been made in the form of a plate. In an electron gun having such a plate type first grid electrode, electrons leak from the first grid electrode to the cathode electrode, and because of the high voltage induced in the glass support rods and the inside wall of the neck bulb of the tube, arcing between the glass rod and the neck bulb occurs. Also, evaporated metal sputtered from the electron emissive coating adheres to the glass rods and causes insulation breakdown between a cathode and the first grid electrode.

In order to prevent these occurrances, the bead is arranged in the first grid electrode so as to surround the electron emissive coating as much as possible, but even then fouling of the glass rods by sputter cannot be prevented altogether.

SUMMARY OF THE INVENTION

The present invention has been made in order to eliminate these defects of the known technology, thereby obtaining a highly improved electron gun structure.

Accordingly, an object of this invention is to provide an improved electron gun structure.

Another object of this invention is to provide an improved electron gun structure which protects the heater coil from high voltage.

Another object of this invention is to provide an improved electron gun structure which protects the electron emissive coating on the cathode electrode from arcing by high voltage.

A further object of the present invention is to provide an improved electron gun structure which is used for a color picture tube.

A still further object of the present invention is to provide an improved electron gun structure which is used for a color picture tube of a quick emission start type.

A still further object of the present invention is to provide an improved electron gun structure which prevents insulation breakdowns between the cathode electrode and the first grid electrode of a plate.

These and other objects of the invention are achieved by providing an electron gun structure which includes at least one cathode electrode, a plurality of grid electrodes including a first grid electrode and a heater coil. The cathode electrode consists of a tubular cathode sleeve and an electron emissive coating formed on the closed end of it. The heater coil is positioned within the cathode sleeve and has legs welded to the heater supporting straps. The surfaces of the heater straps adjacent cathode sleeve are constructed such that the arcing start potential between the cathode electrode and the heater supporting straps is lower than the arcing start potential between the cathode electrode and the heater coil, so that arcing to the heater itself is prevented. Furthermore, the arcing start potential between the exposed metal part of the cathode electrode and the first grid electrode is made lower than the arcing start potential between the electron emissive coating on the cathode sleeve and the first grid electrode, so that undesired arcing to the electron emissive coating is also prevented.

BRIEF DESCRIPTION OF THE DRAWINGS

A more complete appreciation of the invention and many of the attendant advantages thereof will be readily obtained as the same becomes better understood by reference to the following detailed descripti n when considered in connection with the accompanying drawings, wherein.

DETAILED DESCRIPTION OF THE PREFERRED EMBODIMENTS

Figure 1:
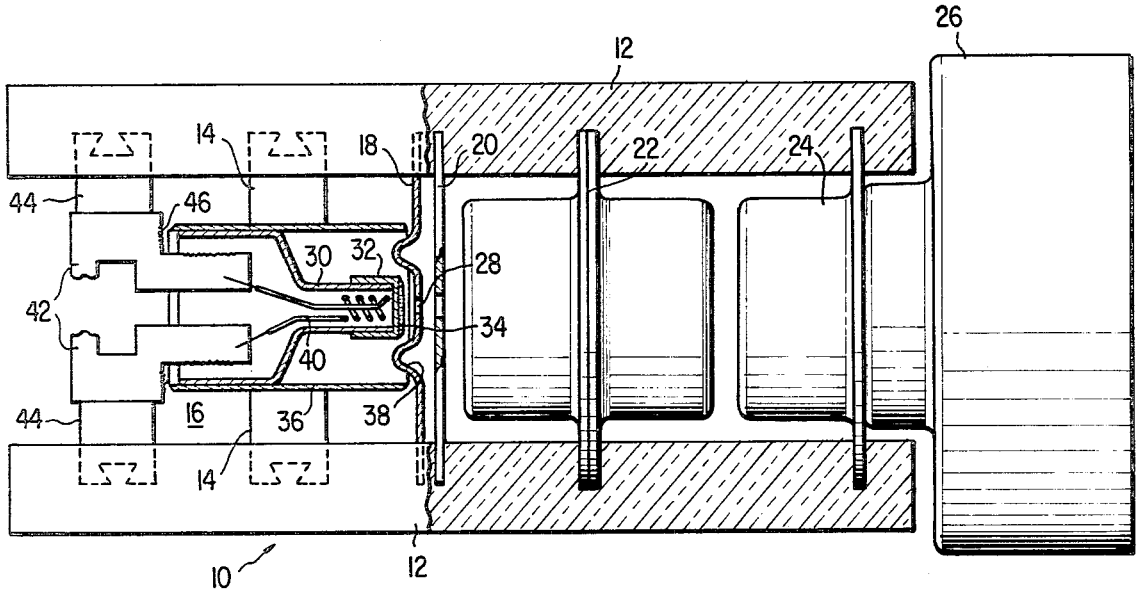
FIG. 1 is a side view, partly in axial section, of a first embodiment of an electron gun structure in which the present invention is incorporated.

Referring now to the drawings, wherein like reference numerals designate identical or corresponding parts throughout the several views, and more particularly to FIG. 1 thereof, an electron gun structure 10 consists of two parallel glass support rods 12 between which various gun elements are mounted. At one end of the glass support rods 12 are mounted several support pieces 14 on which three cathode electrodes 16 are fastened. Following the support pieces 14, a first control grid electrode 18, a screen grid electrode 20, a first and second accelerating and focusing electrode 22, a focusing electrode 24, and a shield cup 26 are mounted in the order named. The first grid electrode 18 is made of a flat metal element containing a bead 38 and three apertures 28 which are aligned with a different beam path.

Each cathode electrode 16 comprises a tubular cathode sleeve 30, closed at the forward end by a cap 32 having an end coating 34, of electron emissive material and a cathode shield 36. Each cathode sleeve 30 is supported in a tubular metal shield 36. The shield 36 is supported on the insulator rods 12 by support pieces 14. The sleeve 30 has an open end with a diameter larger than the diameter of its front closed end, and the tubular metal shield 36 extends from this open end part of the sleeve 30 towards the first grid electrode 18. The front edge of the shield is made acute or rough. Another suitable form of the edge surface is possible. The acute or rough edge surface of the shield 36 is extended so as to surround the bead 38 of the first grid electrode 18, and the distance between the front edge of the shield 36 and the adjacent surface of the first electrode 18 is kept smaller than the distance between the electron emissive coating surface 34 on the cathode sleeve and the first grid electrode 18.

The cathode 16 is indirectly heated by a heater coil 40 which is positioned within the cathode sleeve 30 and which has legs welded to heater supporting straps 42 and mounted by studs 44 on the rods 12.

The surfaces 46 of the heater supporting straps 42 adjacent the cathode sleeve 30 are also made sharp or acute or rough and they are positioned close to the open end of the sleeve 30.

In the gun structure of this invention, the open end portion of the cathode sleeve 30 is close to the acutely-angled or rough surfaces of the heater straps 42. Therefore, the arcing start potential between the cathode electrode 16 and the heater supporting straps 42 is kept lower than the arcing start potential between the cathode sleeve 30 and the heater coil 40.

Consequently, when a high voltage is applied, arcing occurs only between the cathode electrode 16 and the heater supporting straps 42, and there is no arcing between the cathode sleeve 30 and the heater coil 40. Accordingly, the insulating layer of the heater 40 is prevented from deteriorating. Also, the danger that the core wire of the heater 40 can be fused is eliminated.

Furthermore, in this electron gun structure, the acute or rough front edge of the cathode shield 36 is in close proximity to the adjacent surface of the first grid electrode 18. Therefore, the arcing start potential between the cathode shield 36 and the first grid electrode 18 is kept lower than the arcing start potential between the electron emissive coating 34 and the first grid electrode 18.

Consequently, when a high voltage is applied, arcing occurs only between the cathode shield 36 and the first grid electrode 18. Accordingly, there is no danger that the electron emissive coating 34 will deteriorate.

Moreover, the front end of the cathode shield 36 is located outside of the bead 38 of the first grid electrode 18 and close to the first grid electrode 18, and therefore, the electrons emitted from the cathode electrode will not reach the glass rods or the inside wall of the neck bulb of the tube. Accordingly, even if a high voltage is induced between the rods 12 and the inside wall of the neck bulb, no arcing will occur between them.

Also, evaporated metal sputtered from the electron emissive coating 34 is screened by the shield 36 and the bead 38 of the first grid electrode 18, and therefore will not reach the glass rods 12. Accordingly, insulation breakdown of the glass rods 12 due to the evaporated metal is prevented.

Now, it is desirable that the arcing start potential between the cathode shield 36 and the first grid electrode 18 be about the same as the maximum rated voltage between the cathode electrode and the first grid electrode of the cathode ray tube in which the electron gun is incorporated.

Figure 2:
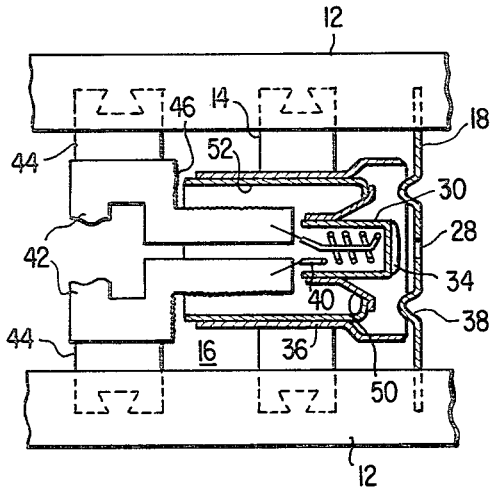
FIG. 2 is an axial section view of the essential parts of another embodiment according to this invention.

FIG. 2 shows the essential part of another embodiment of the electron gun structure. The cathode electrode 16 includes a tubular cathode sleeve 30, sleeve support members 50, and a long pseudo-terminal element 52 extending towards the heater supporting straps 42 so that the end of the pseudo-terminal element 52 is close to the acute or rough edge surfaces 46 of the heater supporting straps. A cathode shield 36 supports the terminal element 52 and extends towards the region outside the bead 38 of the first grid electrode 18. The front edge of this shield faces the first grid electrode and the distance between the front edge of the shield 36 and the first grid electrode 18 is less than the distance from the first grid electrode 18 to the electron emissive coating 34 formed on the closed end surface of the cathode sleeve 30.

The cathode electrode 16 is mounted by strap pieces on the glass rods 12 and is indirectly heated by a heater coil 40 positioned within the cathode sleeve 30 and mounted by studs 44 on the glass rods 12.

In this electron gun structure, the end of the pseudo-terminal element 52 is close to the acute edge surfaces 46 of the heater supporting straps 42 and therefore, the arcing start potential between the cathode electrode 16 and the heater supporting straps 42 is maintained lower than the arcing start potential between the cathode sleeve 30 and the heater coil 40.

Also the acute or rough front edge surface of the cathode shield 36 is close to the first grid electrode 18 so that the arcing start potential between them is lower than the arcing start potential between the electron emissive coating 34 and the first grid electrode 18.

Accordingly, this arrangement is protected for the same reasons as is the embodiment of FIG. 1 as discussed above.

Figure 3:
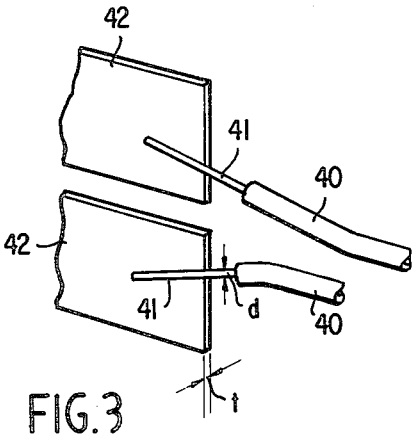
FIG. 3 is a perspective view of the mounting parts of the heater of the electron gun structure of the present invention.

Now, if the thickness t of the heater supporting straps 42 is made smaller than the diameter d of the core wire 41 of the heater 40, as shown in FIG. 3, then arcing is advantageously facilitated even when the edge surfaces of the heater supporting straps confronting the cathode electrode are made smoothly flat.

Now, practical construction for making arcing between the cathode electrode and the heater supporting straps easier than arcing between the cathode and the heater coil is not restricted to the examples described previously. This is also true as regards making arcing between the cathode shield and the first grid electrode easier than arcing between the electron emissive coating formed on the closed end of the cathode sleeve and the first grid electrode.

Thus, in the electron gun structure of the present invention, the arrangements are such that arcing can easily occur between the metal exposed part of the cathode electrode and the first grid electrode or the heater supporting straps, and therefore, undesired arcing between the cathode electrode and the heater coil is prevented so that breakage of the heater coil is prevented. Also, undesired arcing between the electron emissive coating formed on the cathode sleeve and the first grid electrode is prevented so that deterioration of the electron emissive coating is prevented.

Further, electron radiation and sputter in undesired directions from the electron emissive coating is screened off, and therefore, there is no adhesion of evaporated metal to the glass rods or the like and accordingly unexpected trouble due to insulation breakdown is prevented from occuring.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electron gun structure for producing and directing at least one electron beam along a beam path, said gun structure comprising:

at least one cathode electrode, said cathode electrode comprising a cathode sleeve, a plurality of grid electrodes including a first grid electrode, an electron emissive coating formed on the closed end surface of said cathode sleeve adjacent said first grid electrode, a cathode shield supporting said cathode sleeve and extending towards said first grid electrode, a heater being positioned within said cathode sleeve, and the front edge of said cathode shield being close to said first grid electrode such that the distance between them is smaller than the distance between said electron emissive coating and said first grid electrode, wherein said first grid electrode is made in the form of a plate and has at least one bead and, said cathode shield extends outside of said bead.

* * * * *